US009216880B2

(12) United States Patent
Willis et al.

(10) Patent No.: US 9,216,880 B2
(45) Date of Patent: Dec. 22, 2015

(54) HEADER SYSTEM

(71) Applicant: Interface, Inc., Atlanta, GA (US)

(72) Inventors: Tammy Michelle Willis, LaGrange, GA (US); Johnny E. Daugherty, Valley, AL (US); Brian H. Harrell, Auburn, AL (US); William Oscar Ingram, III, Valley, AL (US)

(73) Assignee: Interface, Inc., Atlanta, GA (US)

( * ) Notice: Subject to any disclaimer, the term of this patent is extended or adjusted under 35 U.S.C. 154(b) by 321 days.

(21) Appl. No.: 13/785,167

(22) Filed: Mar. 5, 2013

(65) Prior Publication Data

US 2013/0228644 A1 Sep. 5, 2013

Related U.S. Application Data

(60) Provisional application No. 61/606,520, filed on Mar. 5, 2012.

(51) Int. Cl.

| | |
|---|---|
| ***B65H 57/06*** | (2006.01) |
| ***B65H 49/16*** | (2006.01) |
| ***B65H 57/12*** | (2006.01) |
| ***B65H 57/16*** | (2006.01) |
| ***D03D 39/06*** | (2006.01) |
| ***D05C 15/18*** | (2006.01) |

(52) U.S. Cl.

CPC ..... *B65H 57/06* (2013.01); *B65H 49/16* (2013.01); *B65H 57/12* (2013.01); *B65H 57/16* (2013.01); *D03D 39/06* (2013.01); *D05C 15/18* (2013.01); *B65H 2701/31* (2013.01)

(58) Field of Classification Search

CPC combination set(s) only.

See application file for complete search history.

(56) References Cited

U.S. PATENT DOCUMENTS

| | | | |
|---|---|---|---|
| 4,498,644 | A | 2/1985 | Kupper et al. |
| 5,024,393 | A | 6/1991 | Gutschmit |
| 5,531,392 | A | 7/1996 | Weiner |
| 5,588,383 | A | 12/1996 | Davis et al. |

(Continued)

FOREIGN PATENT DOCUMENTS

| | | |
|---|---|---|
| CN | 1332815 | 1/2002 |
| CN | 101050684 | 10/2007 |

(Continued)

OTHER PUBLICATIONS

U.S. Appl. No. 13/164,321, "Non-Final Office Action," filed Jan. 30, 2014, 10 pages.

(Continued)

*Primary Examiner* — Emmanuel M Marcelo
*Assistant Examiner* — Angela Caligiuri
(74) *Attorney, Agent, or Firm* — Kilpatrick Townsend & Stockton LLP

(57) ABSTRACT

Header assemblies generally used to handle yarns, for example, to facilitate connection of yarns feeding into a tufting machine or other device. In some embodiments, the improved header assembly includes at least a detachable header and a collector plate. The improved header assembly simplifies the process of loading yarn through a detachable header by positioning the detachable header so that it abuts the collectable plate so that individual yarns can be blown through the collector plate through the appropriate holes in the detachable header. In some embodiments, the header assemblies are configured for use with varying gauges, different alignment requirements, different devices, and/or to otherwise be more universal in nature.

18 Claims, 7 Drawing Sheets

(56) References Cited

U.S. PATENT DOCUMENTS

| | | | | |
|---|---|---|---|---|
| 5,624,082 | A | 4/1997 | Ligon | |
| 6,073,434 | A * | 6/2000 | Amos | 57/22 |
| 6,634,585 | B1 | 10/2003 | Ingram, III | |
| 7,004,415 | B2 | 2/2006 | Ingram, III | |
| 7,316,366 | B2 | 1/2008 | Ingram, III | |
| 7,506,831 | B1 | 3/2009 | Weiner | |
| 8,869,720 | B2 | 10/2014 | Ingram, III et al. | |
| 2006/0049297 | A1 | 3/2006 | Ingram, III | |
| 2007/0084960 | A1 | 4/2007 | Heaney et al. | |
| 2008/0173643 | A1 | 7/2008 | Wadsworth et al. | |
| 2011/0041088 | A1 | 2/2011 | Mason et al. | |
| 2011/0308438 | A1 | 12/2011 | Ingram, III et al. | |

FOREIGN PATENT DOCUMENTS

| | | | |
|---|---|---|---|
| CN | 103069066 | A | 4/2013 |
| JP | 2015513507 | | 5/2015 |
| UY | 33460 | A | 1/2012 |
| WO | 0027532 | A1 | 5/2000 |
| WO | 0028119 | | 5/2000 |
| WO | 2011160121 | A2 | 12/2011 |
| WO | 2011160121 | A3 | 12/2011 |
| WO | 2013134191 | | 9/2013 |

OTHER PUBLICATIONS

U.S. Appl. No. 13/164,321 , "Notice of Allowance," Aug. 19, 2014, 5 pages.

International Patent Application No. PCT/US2011/041088, International Preliminary Report on Patentability, mailed Jan. 3, 2013, 19 pages.

International Patent Application No. PCTUS2013028995, International Search Report and Written Opinion Received, mailed May 28, 2013, 10 pages.

CN201180039905.4, "Office Action", Sep. 3, 2014, 10 pages.

PCT/US2013/028995, "International Preliminary Report on Patentability", Sep. 18, 2014, 7 pages.

Chinese Office Action 201180039905.4, Office Action mailed on May 25, 2015, 15 pages. (6 pages of Original document and 9 pages of English Translation).

* cited by examiner

HEADER SYSTEM

CROSS REFERENCE TO RELATED APPLICATION

This application claims priority benefits from U.S. Provisional Application Ser. No. 61/606,520 filed Mar. 5, 2012 and titled "Improved Header System," the contents of which are incorporated herein by reference.

FIELD OF THE INVENTION

This invention relates to systems and methods for manufacturing carpet, carpet tiles, and other products using tufting machines, and more specifically, systems and methods for handling yarn supplied to tufting machines.

BACKGROUND

Tufting machines are used in the manufacture of various textile products. A tufting machine typically receives multiple yarns that are used by the tufting machine to create loops or tufts in a backing material. In many tufting machines, each of multiple adjacent needles uses a thread of yarn to tuft a row of tufts in the backing material. Because many such needles may require different yarns simultaneously, many tufting machines require that multiple yarns be fed into or otherwise received by the tufting machine at relatively the same time. However, some fabric patterns utilize yarns of differing lengths, with the result that tufting machines producing such patterns require yarns feeding into the machine at different rates. If yarns are to be used at different rates in the tufting process, the yarns may be supplied from a creel or other structure that can supply different yarn ends at different rates.

A header assembly may be used to feed the various yarns through the tufting machine or other equipment. It is important that the yarns be properly aligned so that the relative positions of the yarns are fixed before they feed into the tufting machine. In some instances, the yarns also need to be aligned in areas remote from the tufting machine, such as at the creel or other structures such as a beam. There is also sometimes a need to align the yarns at a burn rack or other splicing device, which can be used to attach the ends of yarns feeding off of a creel to ends of yarns already feeding into the tufting machine.

Some header assemblies include a stationary header associated with the creel or other structure such as a beam and a detachable header. Both the stationary header and detachable headers have holes through which multiple yarn ends extend. The positioning of the holes of the detachable header allows for the bulk transfer of aligned yarns from one location (such as the creel or beam) to another location by moving the detachable header along with the threads that are aligned through its holes. In some processes, all of the yarns are positioned on a creel so that they extend through individual holes in the stationary header as well as individual holes in the detachable header so that the detachable header may be removed and used to transfer the yarn ends to another location, such as to a burn rack or other splicing device for attachment to the tufting machine yarns.

Passing yarn through the holes of the stationary header and the holes of the detachable header has generally been time consuming and inefficient. For example, for each yarn bobbin or package, the process may require manually inserting the yarn end into a small plastic tube coupled to the holes of the stationary header and using an air "gun" and compressed air to blow the yarn through the tube until the yarn end projects from the other end of the tube, for example, through one of the holes of the stationary header. In some cases, the tube extends through the holes of the stationary header. As such, the holes of the stationary header have to be large enough to accommodate each of the tubes. Typically, the holes of the stationary header were thus required to be so large that all of the holes could not be fit widthwise across the stationary header in a single, horizontal row. Instead, the holes in each row had to be staggered across the width of the stationary header. Moreover, the holes typically formed several rows. In contrast, detachable headers traditionally have only a single horizontal row of holes because it was believed that a single row allowed for better alignment with the burn rack or other splicing device. As such, to feed the yarn ends from the stationary header through the detachable header, the stationary header had to be positioned remote from the detachable header and each strand of yarn had to be manually fed from the holes of the stationary header into the holes of the detachable header. This process was time consuming, tedious, and also error prone, as yarn ends coming from a particular hole of the stationary header were often inadvertently fed into in the wrong hole of the detachable header.

Once the yarn ends were so positioned through the one or more header assemblies (through the stationary and detachable headers), they could then be attached to existing yarns already feeding into a tufting machine or other device. In some instances, the yarns could be transferred in bulk by moving the detachable header away from the stationary header associated with the creel or other device to a burn rack or other splicing device. The burn rack or other splitting splicing device could then be used to attach the yarns feeding through the detachable header to existing yarns already feeding into a tufting machine. It is important to align the yarns from the detachable header properly with the yarns feeding into the tufting machine. Thus, the process of aligning yarns from the detachable header with the burn rack or other splicing machine is time consuming and error prone.

Moreover, because different tufting machines have different gauges (and thus each accommodate a different number of yarn ends), a specific header assembly having a specific number of holes has been typically provided for use with a specific tufting machine having a gauge that corresponds to the specific number of holes in the header assembly. Because the stationary header is typically permanently or semi-permanently affixed to a creel, the use of that particular creel has typically been limited to a tufting machine having a gauge that corresponds to the number of holes on the stationary header. As a result, tufting machines and creels sometimes remain idle until a creel with a header assembly having a sufficient number of holes is available for use with a tufting machine having a gauge that corresponds to that sufficient number of holes.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed are one or more header assemblies generally used to align yarns, for example, to facilitate connection of yarns feeding into a tufting machine or other device. The header assemblies include a detachable header that allows for the bulk transfer of aligned yarns to another location. In some instances, the header assemblies may be positioned on or near a creel rack and may be also positioned on or near the tufting machine.

In some embodiments, the improved header assembly includes at least a detachable header and a collector plate. The improved header simplifies the process of loading yarn through a detachable header by positioning the detachable header abutting the collector plate so that individual yarns can be blown through the collector plate and through the appropriate holes in the detachable header. Once the yarns are through the detachable header, the detachable header may be removed and used to transfer the aligned yarn ends to another location. For example, the detachable header may be repositioned for use on a burn rack or other splicing device, where those aligned yarns are attached to yarns already feeding into the tufting machine. The detachable header may include alignment notches and/or graduated holes. The improved header assemblies may be configured so that the yarn ends move more efficiently through the header assembly. The holes of the collector plate may generally align with the holes of the detachable header when the collector plate and the detachable header abut one another. The header assemblies may be configured for use with varying numbers of yarns (without requiring retrofit), different alignment requirements, different devices, or to otherwise be more universal in nature.

BRIEF DESCRIPTION OF THE DRAWINGS

Illustrative embodiments of the present invention are described in detail below with reference to the following drawings, in which use of like reference numerals in different figures is intended to illustrate like or analogous components.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
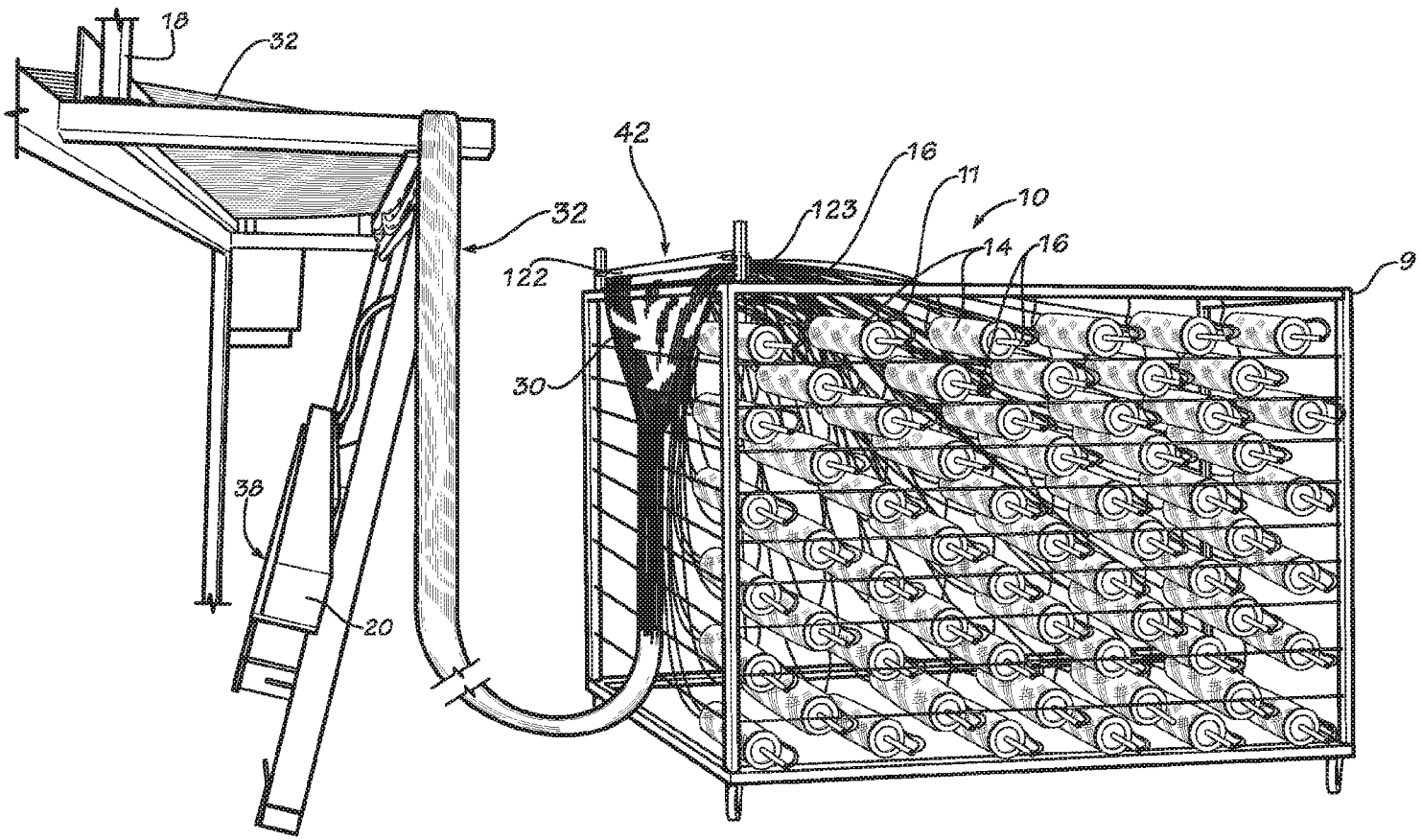
FIG. 1 is a perspective view of a header assembly according to one embodiment of this invention positioned on a creel containing a plurality of yarn packages with yarns feeding into a burn rack and a tufting machine.

FIG. 1 illustrates a portable creel 10. The portable creel 10 is a frame or rack 9 with an array of holders on which yarn packages 14 are positioned. The yarn end 11 from each package 14 is fed into the package end of a tube that leads to a collector plate 123. A header assembly 42 includes collector plate 123 mounted on the creel frame and a detachable header 122. In some embodiments, only one header assembly is mounted on the creel, but two or more header assemblies may also be mounted on the creel. Although header assembly 42 illustrated in FIG. 1 is positioned near the top of creel 10, header assembly 42 could be positioned in any other suitable location, such as in the middle of the creel or elsewhere. For example, the header assembly 42 may be positioned so it can be accessed by a user without a ladder or height assistance.

As shown in FIG. 1, each of a plurality of yarn packages 14 is positioned relative to an end of one of the flexible tubes 16 that are attached to the creel. The other ends of the tubes 16 terminate in the collector plate 123, which may be (but need not necessarily be) permanently attached to the creel 10. As shown in FIG. 1, each of the many yarns on the creel 10 is fed through one of a plurality of holes 128 (FIG. 9) on the detachable header 122. The detachable header 122 is configured so it can be removed and used to connect yarns 30 extending through the detachable header with yarns 32 already threaded into a tufting machine 18 by loading the yarn 30 ends over to the vicinity of the yarn 32 ends.

In some embodiments, instead of positioning the yarn packages 114 on holders mounted on the creel 10 frame, the yarn packages 14 are positioned within trays within the creel, as disclosed in U.S. application Ser. No. 13/164,321 filed on Jun. 20, 2011 titled "Portable Creels with Insertable Yarn Trays and Improved Headers and Yarn Handling Methods," the contents of which are incorporated herein by reference. If trays are used, the header system may be positioned between two rows of trays in some embodiments.

As shown in FIG. 1, a burn rack 20 (or other suitable splicing device) may be used to attach the yarns 32 already threaded into the tufting machine 18 with the yarns extending through the detachable header 122. In some embodiments, the holes 128 of the detachable header 122 are spaced in a predetermined pattern so that, when positioned with respect to the burn rack 20, the individual yarns are positioned for easy attachment to the individual yarns 32 already feeding through the tufting machine 18. In other words, the spacing between the yarns is fixed by the structure of the header to match spacing on the burn rack or other splicing device. In some processes, yarns 32 from the tufting machine and yarns 30 from the detachable header 122 are aligned within a gauge bar 38 of the burn rack 20 and melted together. Then, tufting proceeds using the yarns 30 feeding from the newly attached detachable header 122.

Figure 2:
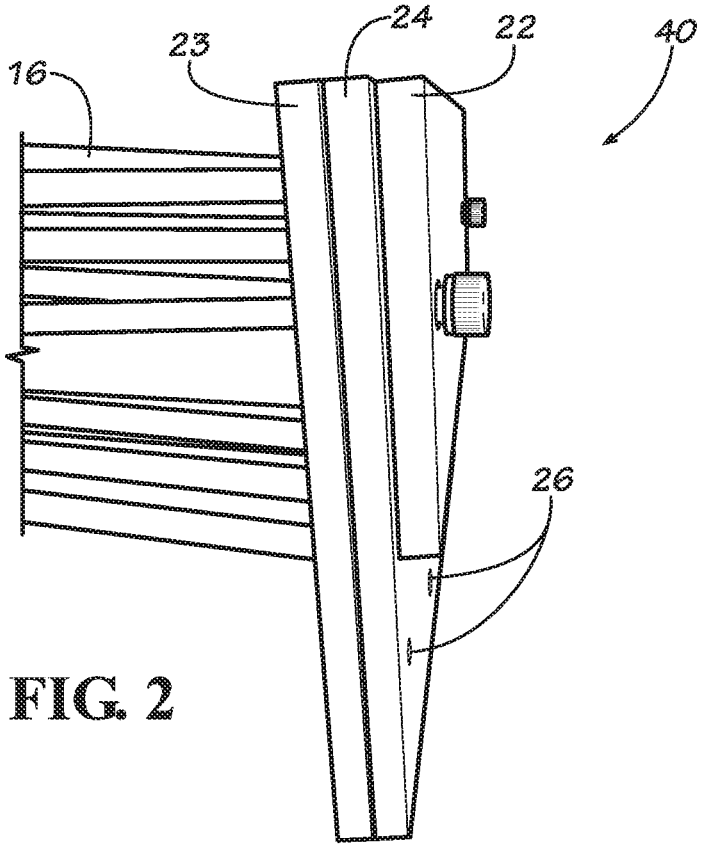
FIG. 2 is a perspective side view of a header assembly of an embodiment of the invention.

A header assembly 40 shown in FIG. 2 includes a detachable header 22 that abuts a face plate 24 that abuts a collector plate 23. The holes of the collector plate 23 are large enough to accommodate tubing 16, as the collector plate is used to align and collect the tubing 16. The holes of the collector plate 23, the holes of the face plate 24, and the holes of the detachable header 22 are positioned on each respective plate in a predetermined pattern so that when the three plates abut one another, the holes of the three plates generally align. Because the detachable header 22 abuts the face plate 24, the process of loading yarns through the detachable header is simplified. More specifically, when an individual yarn is blown through a hole in the face plate and/or collector plate, it is also blown through the appropriate hole of the detachable header due to the positioning of the detachable header with respect to the face plate. This can reduce the labor required to feed the yarns through the detachable header 22.

Figure 8:
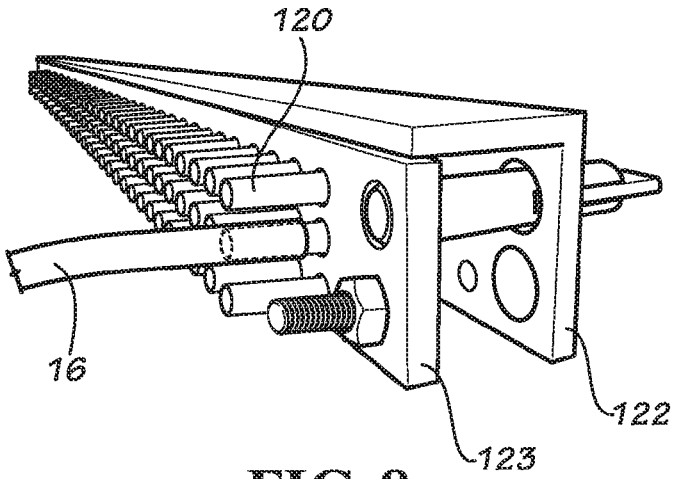
FIG. 8 is a perspective view of one end and the creel side of the header assembly of FIG. 1.
Figure 9:
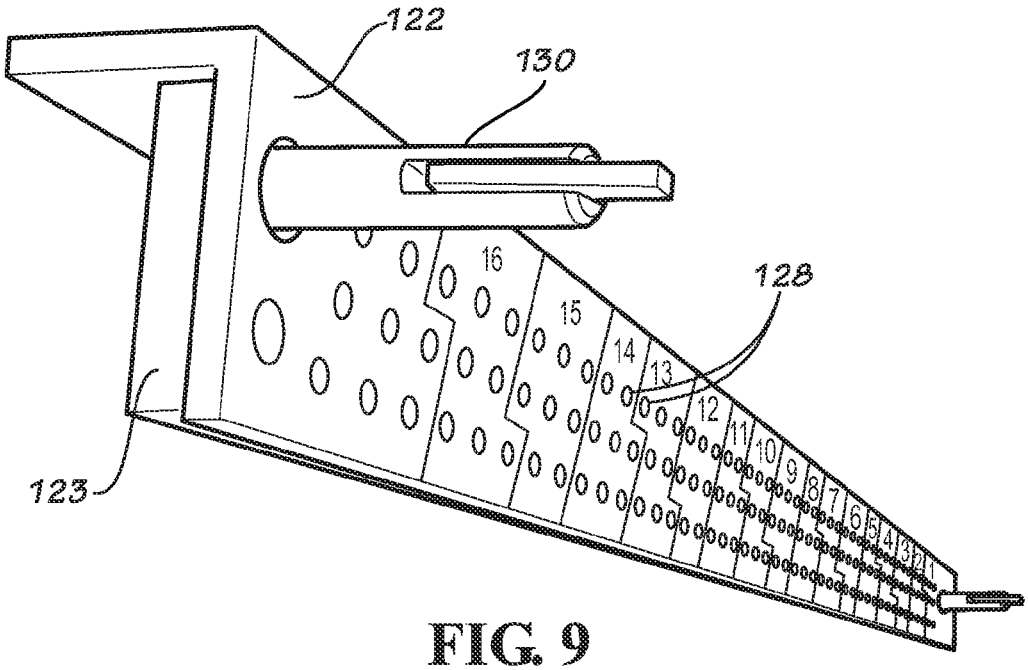
FIG. 9 is a perspective view of the same end and front of the header assembly of FIG. 8.

Other embodiments of the header assembly do not require the use of face plate 24. For example, FIGS. 8-9 show various views of another version of a header assembly that includes a detachable header 122 and a collector plate 123, but does not include a face plate. The embodiment of FIGS. 8-9 is described in more detail below.

In some embodiments, the face plate 24 and/or collector plate 23 and the detachable header 22 include a spring loaded handle (such as spring loaded handle 130 shown in FIG. 9) to hold the detachable header snuggly in place relative to the face plate 24 and/or the collector plate 23. Specifically, the spring loaded handle 130 secures the plates together until the spring is compressed and the handle can be removed. In other embodiments, hitch pins, magnets, and/or any other suitable mechanisms are used to secure the positioning of the face plate (or collector plate) against the detachable header.

Figure 3:
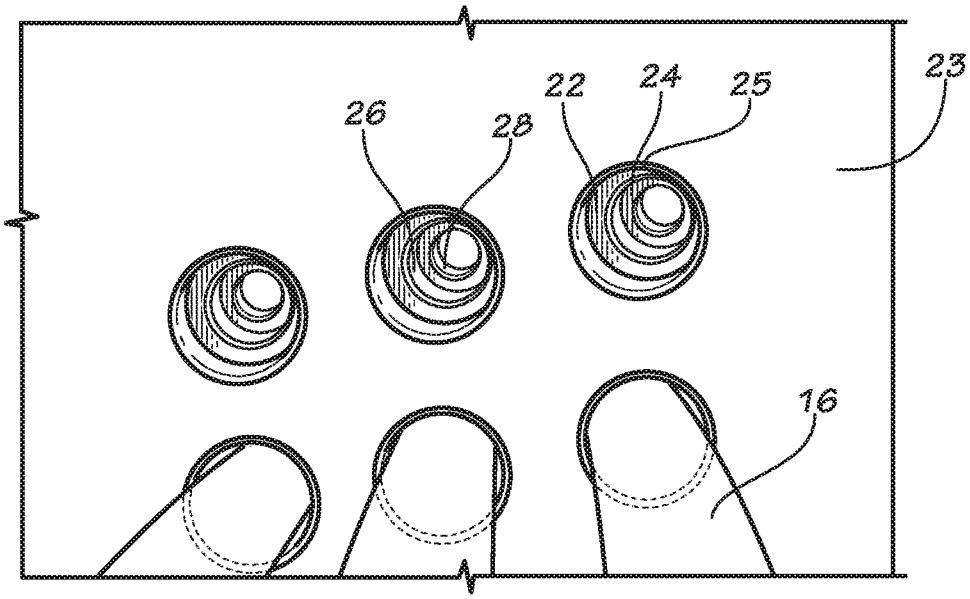
FIG. 3 is a rear view of a portion of the header assembly of FIG. 2.
Figure 4:
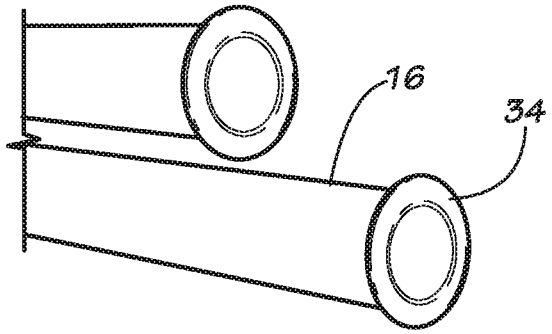
FIG. 4 is a perspective view of flared tubing ends.

As shown in FIG. 3, in some embodiments, holes 25 in the collector plate 23 may be graduated and chamfered to help ensure the unrestricted movement of the yarn. The chamfers of the holes 25 help prevent the yarns from getting caught on the edges of the holes as the yarn passes through the plates when they penetrate the plates. Holes 28 in the detachable header 22 and/or the holes 26 in the face plate 24 may also be graduated to assist with the guiding of the yarn through the plates and minimize the opportunity for the yarn to catch on the holes. In some embodiments, the system also includes flared tubing 16 having a lip 34, shown in FIG. 4, that is configured to fit snuggly with the holes 25 of the collector plate 23.

The detachable header is configured so that it may lay flush against the face plate 24 or collector plate 23 or 123 so that compressed air or a vacuum could be used to push or pull one end of the yarn through the headers without the need for manual threading of the yarns through the holes between the face plate or collector plate and the holes in the detachable header. After being moved through the flexible tubing that guides each yarn from each yarn package, the yarn strands move directly through the holes 25 in the collector plate 23 or 123 and, in some embodiments, through the holes 26 in the face plate 24, and through the holes 28 in the detachable header 22 or 122. This is because the holes of each of the plates are arranged in a pattern such that the holes of each of the plates align when the plates abut one another.

Figure 5:
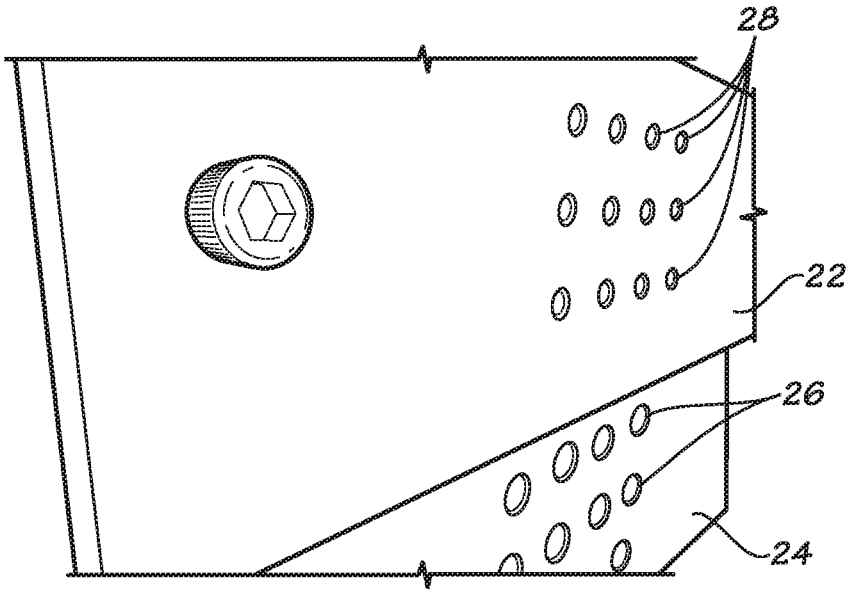
FIG. 5 is a perspective view of a front portion of the header assembly of FIG. 2.
Figure 6:
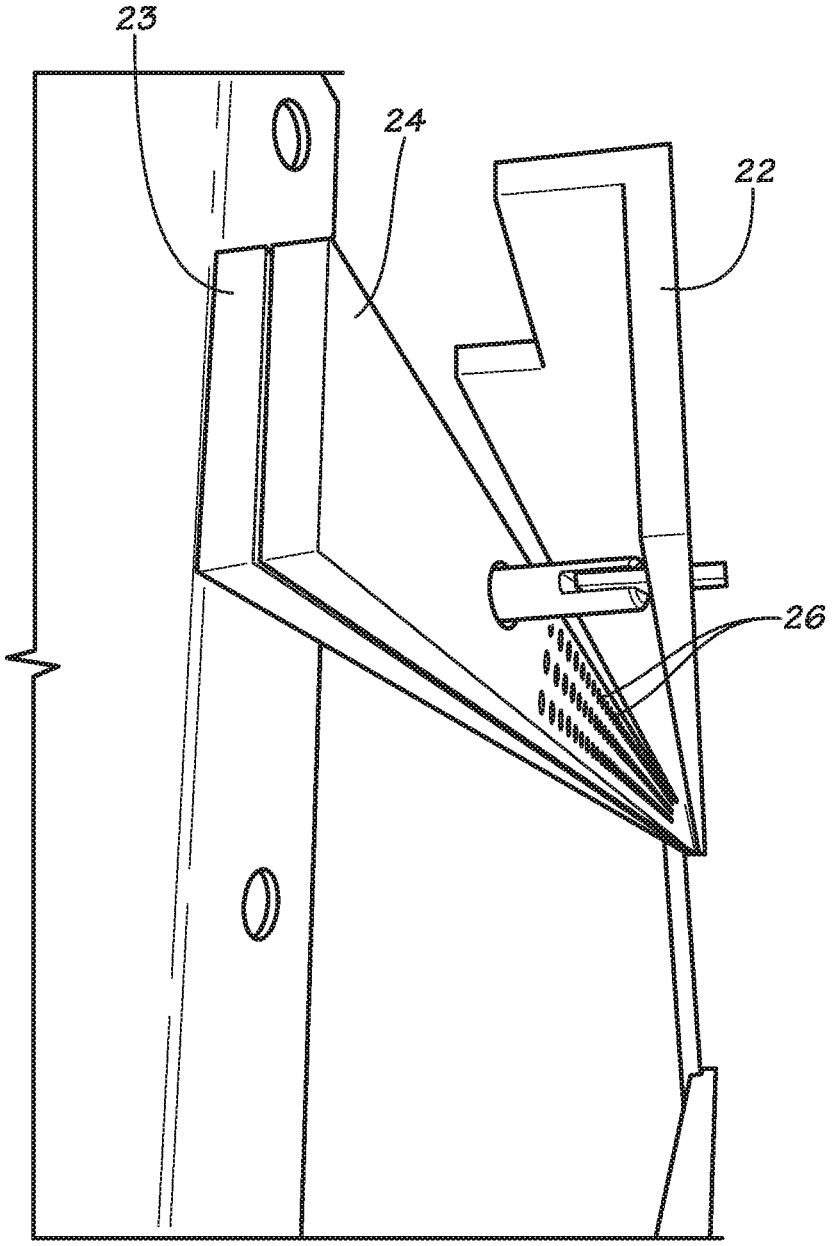
FIG. 6 is a perspective view of a header assembly according to another embodiment of this invention.
Figure 7:
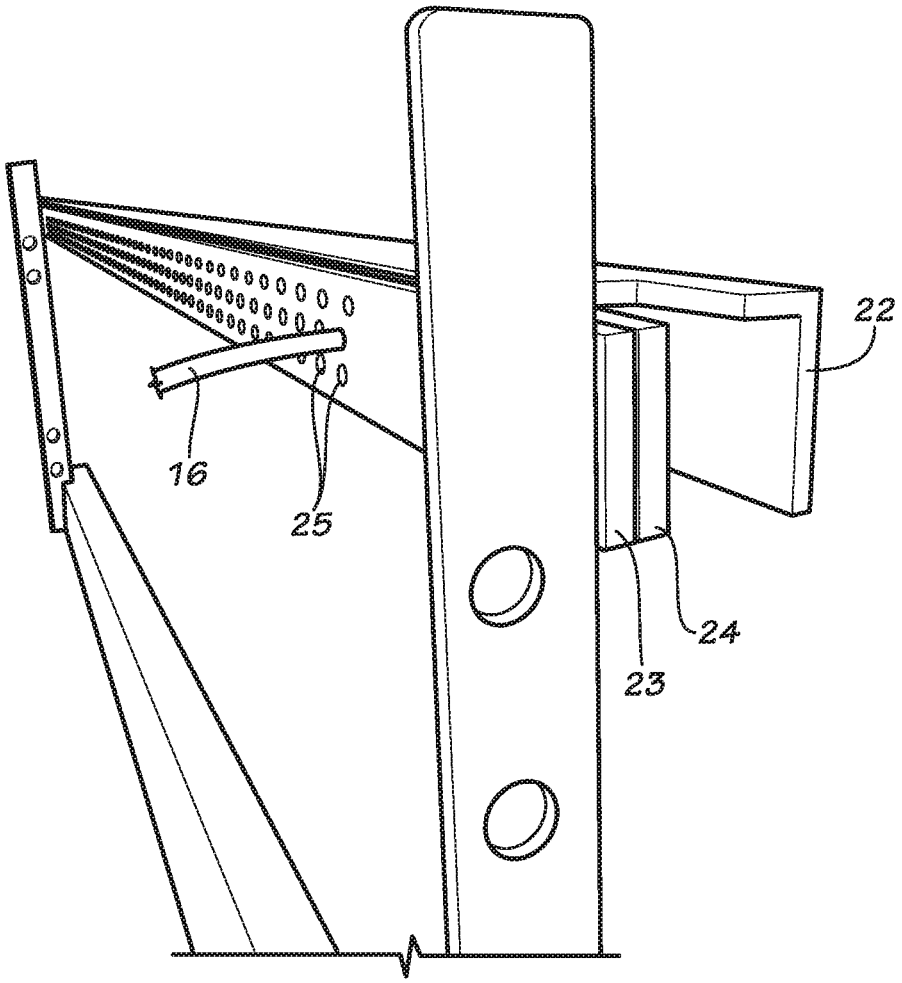
FIG. 7 is another perspective view of one end and the tufting machine side of the header assembly of FIG. 6.

In some embodiments, detachable headers 22 and 122 include three rows of holes 28 and the face plate 24 and/or the collector plates 23 and 123 include three rows of holes 26 as shown in FIG. 5. As mentioned above, the three rows of holes 26 of the face plate 24 are configured to align with the three rows of holes 28 of the detachable header 22 when the detachable header 22 is abutted against the face plate 24. In other embodiments, more or fewer rows of holes are used. The use of multiple rows of holes allows the width of the detachable header to be reduced while still allowing the header to accommodate various gauges of tufting machines. Moreover, the number of rows and spacing of holes provided on each of the detachable header and the face plate and/or collector plate is predetermined to provide a sufficient number of holes appropriately spaced to allow for use of the header assembly with different tufting machines having different gauges, thus making the header assembly "universal" in nature.

In some embodiments, the rows of holes on each of the detachable header and the face plate and/or collector plate are generally horizontal as shown in FIG. 5, while each row of holes is somewhat staggered from the next row of holes so that the rows of holes are arranged generally diagonally in the vertical direction. This arrangement allows the detachable header and the face plate and/or the collector plate to be mounted flush against one another while accommodating the dimensions of the existing creels. In this way, the disclosed headers facilitate the movement of yarn ends through the header assembly and improve flexibility of equipment, minimizing capital investment because the header assembly is, as described above, more "universal" in nature.

In another embodiment, shown in FIGS. 8-9, the header assembly includes a collector plate 123 aligned with a detachable header 122 without the need for a face plate. FIG. 8 shows a collector plate 123 as it is aligned with a detachable header 122, and FIG. 9 shows the collector plate 123 abutted against the detachable header 122. The collector plate 123 includes a plurality of steel tubes 120 projecting from collector plate 123. They may be press fit in holes or otherwise attached by, for instance, welding or adhesive, to the collector plate 123. In some embodiments, the tubes 120 are flared for stability in holes 125. The flexible tubing 16 may be fitted onto the tube 120 ends directly, thus eliminating the need for a face plate, although a face plate could still be used if desired. Due to the presence of tubes 120, individual plastic tubes 16 can be replaced without requiring that a face plate be completely separated from the collector plate 123. Moreover, because the flexible tubes 16 fit onto the steel tubes 120, the holes of the collector plate 123 can be smaller than they otherwise would be if the tubing were required to be received in the holes. This allows more holes to fit on a single row across width of the collector plate. Moreover, it allows the hole pattern of the collector plate 123 to match the hole pattern of the detachable header so that the holes of the collector plate generally align with the holes of the detachable header when the collector plate is abutted against the detachable header.

Although detachable header 122 and collector plate 123 are shown with three rows of holes, as described above, any number and/or rows of holes may be used. As mentioned above, in some cases, the number of holes and the number of rows of holes are designed so that the header assembly can work with various tufting machines with different gauges. In other words, the hole pattern of the detachable header 122 and the collector plate 123 is designed to accommodate even the smallest gauge tufting machine. As described above, the rows of holes on each of the detachable header and the collector plate may be generally horizontal as shown in FIG. 9, while each row of holes may be somewhat staggered from the next row of holes so that the rows of holes are arranged generally diagonally in the vertical direction. In this way, the hole pattern is predetermined so that it is universal in nature and can be used with various tufting machines and various splicing machines such as burn racks.

Figure 10:
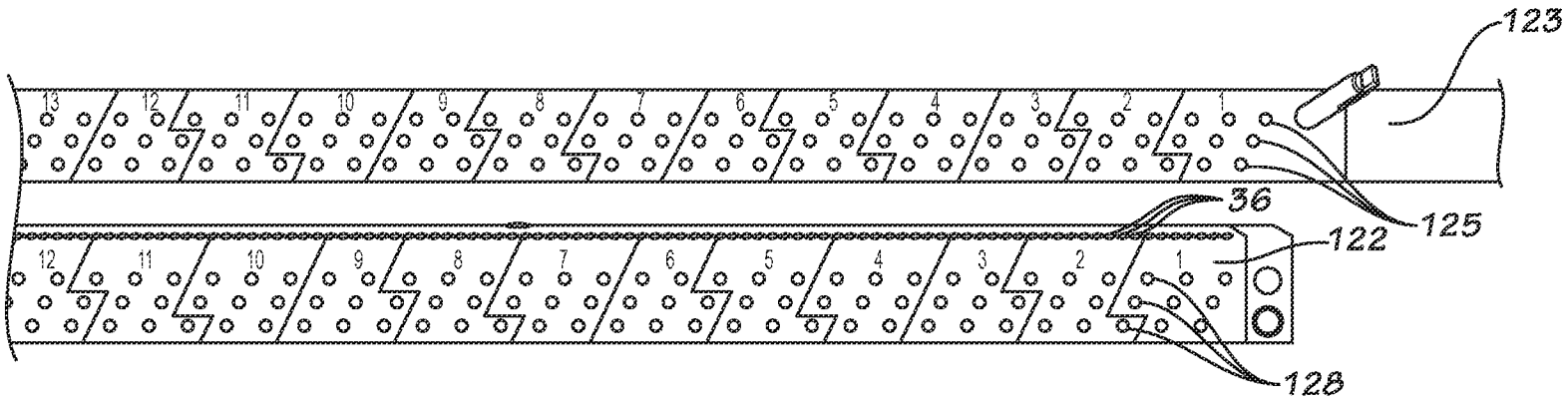
FIG. 10 is a perspective view of a stationary header and detachable header according to another embodiment of this invention.

As shown in FIG. 10, detachable header 122 in some embodiments includes a plurality of alignment notches 36 that align with a gauge bar 38 on the burn rack 20 (see FIG. 1). The alignment notches 36 guide the yarn as it runs down the detachable header so that the yarn falls into the notches 36. Because the notches 36 are spaced in a predetermined manner to align with the burn rack or other splicing device, the alignment notches facilitate appropriate yarn location and spacing when the detachable header 22 is aligned with the burn rack 20 to attach with yarns already running through the tufting machine. Using notches instead of relying solely on the positioning of the header holes reduces the need for the holes to be in certain positions. More specifically, because the holes of the detachable header 22 are not required to be in specific positions, a single header is capable of providing yarns in multiple alignment patterns and yarn spacing, thus allowing use with different burn racks (or other splicing devices) and tufting machines. The use of the alignment notches also improves the efficiency of attaching the yarn ends together. Moreover, the alignment notches guide and improve efficiency in laying in the yarn, which results in an expedited burn-in process. Alignment notches may also be used with detachable header 122 described above.

The disclosed header assemblies can be used in a variety of different portable creel configurations and with a variety of different tufting machines. The improvements help align the yarns of a detachable header of a header assembly with those of a source, such as a creel or a burn rack or other splicing device. Because the improved header assemblies are more universal, the creel frame is also capable of being universal, in that the creel frame can be used with various tufting machines, thus reducing equipment requirements. In this way, the header assemblies provide increased flexibility and adaptability and thus decreased cost. Moreover, quality is improved because the process of blowing yarn ends through the face plate and/or collector plate and detachable header is easier; reducing the manual aspect reduces the chance for a yarn end to be placed within the wrong hole of a header.

Different arrangements of the components depicted in the drawing or described above, as well as components and steps not shown or described are possible. Similarly, some features and subcombinations are useful and may be employed without reference to other features and subcombinations. As an example, the disclosed headers are not limited to a particular industry, but can be used in any industry where material is wound and unrolled such as, but not limited to, rope braiding, carpet manufacture, filament making, tire making, cargo netting, and traditional textiles. Embodiments of the invention have been described for illustrative and not restrictive purposes, and alternative embodiments will become apparent to readers of this patent. Accordingly, the present invention is not limited to the embodiments described above or depicted in the drawing, and various embodiments and modifications can be made without departing from the scope of the claims below.

The invention claimed is:

1. A header assembly comprising:

a collector plate comprising collector plate holes;

a face plate coupled with the collector plate and comprising face plate holes, each of the face plate holes aligned with a respective collector plate hole and configured to receive a respective yarn fed through a respective flexible tube; and a detachable header comprising detachable header holes, the detachable header holes arranged in a plurality of rows staggered from one another and the detachable header detachably secured against the face plate such that at least some of the detachable header holes align with the face plate holes and the collector plate holes.

2. The header assembly of claim 1, wherein the detachable header comprises alignment notches that correspond to at least some of the detachable header holes.

3. The header assembly of claim 1, wherein, when the detachable header and the face plate are secured against one another so that at least some of the detachable header holes align with the face plate holes, the respective yarn received through each face plate hole is blown through the face plate hole directly through one of the detachable header holes.

4. The header assembly of claim 1, wherein the face plate holes and the detachable header holes are arranged in a pattern such that the header assembly is compatible with tufting machines having different gauges.

5. The header assembly of claim 1, wherein the collector plate holes are at least one of graduated or chamfered.

6. The header assembly of claim 1, further comprising a retaining mechanism for releaseably securing the detachable header to the face plate.

7. An assembly comprising:

a collector plate comprising plate holes, wherein a projection projects from at least some of the plate holes, the projection configured to releaseably attach to a respective tube and receive a yarn from the respective tube; and a detachable header comprising detachable header holes, wherein the detachable header holes and the plate holes are arranged in a pattern such that when the detachable header abuts the collector plate, at least some of the detachable header holes align with the plate holes.

8. The assembly of claim 7, wherein the detachable header comprises alignment notches that correspond to at least some of the detachable header holes.

9. The assembly of claim 8, wherein the alignment notches also correspond to at least some holes associated with a burn rack.

10. The assembly of claim 7, wherein, when the detachable header and the collector plate abut one another so that at least some of the detachable header holes align with the plate holes, the yarn received from the respective tube is blown through one of the plate holes directly through one of the detachable header holes.

11. The assembly of claim 7, wherein the plate holes generally form at least one generally horizontal row.

12. The assembly of claim 7, wherein the detachable header holes generally form at least one generally horizontal row.

13. The assembly of claim 7, further comprising a retaining mechanism for releaseably securing the detachable header to the collector plate.

14. The assembly of claim 7, wherein the plate holes are at least one of graduated or chamfered.

15. A method comprising:

moving each of a plurality of yarns from a yarn source, wherein each respective yarn is moved through a respective tube terminating at a respective hole in a collector plate, and through a respective hole in a detachable header, the detachable header detachably secured directly against the collector plate, the holes in the detachable header arranged in a plurality of rows staggered from one another;

detaching the detachable header; and attaching the detachable header at a burn rack such that the plurality of yarns extend through the holes of the detachable header in aligned positions for attachment to other yarns at the burn rack.

16. The method of claim 15, further comprising positioning at least some of the yarns using a plurality of alignment notches of the detachable header, wherein the aligned notches are spaced in a predetermined manner based on the burn rack configuration.

17. The method of claim 15, wherein each respective yarn being moved from the yarn source and through the respective tube terminating at the respective hole in the collector plate comprises moving each respective yarn from the yarn source and through the respective tube terminating at a projection projecting from the respective hole in the collector plate.

18. The method of claim 15, wherein the holes in the collector plate are at least one of graduated or chamfered.

* * * * *